US008746840B2

(12) United States Patent
Kurebayashi et al.

(10) Patent No.: US 8,746,840 B2
(45) Date of Patent: Jun. 10, 2014

(54) MAINTENANCE DEVICE, FLUID EJECTING APPARATUS AND MAINTENANCE METHOD

(75) Inventors: Yoshiyuki Kurebayashi, Chiba (JP); Yoichi Yamada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 77 days.

(21) Appl. No.: 13/112,056

(22) Filed: May 20, 2011

(65) Prior Publication Data

US 2011/0292136 A1 Dec. 1, 2011

(30) Foreign Application Priority Data

May 25, 2010 (JP) ..... 2010-119277

(51) Int. Cl.
*B41J 2/165* (2006.01)

(52) U.S. Cl.
USPC ..... 347/32

(58) Field of Classification Search
CPC ..... B41J 2/1652; B41J 2/1707; B41J 2/16505
USPC ..... 347/29, 84, 85, 30
See application file for complete search history.

(56) References Cited

U.S. PATENT DOCUMENTS

| | | | | |
|---|---|---|---|---|
| 5,424,768 | A * | 6/1995 | Dudek et al. | 347/29 |
| 5,481,283 | A * | 1/1996 | Watanabe et al. | 347/33 |
| 5,635,965 | A * | 6/1997 | Purwins et al. | 347/31 |
| 5,767,877 | A * | 6/1998 | Mei et al. | 347/54 |
| 5,821,958 | A * | 10/1998 | Lim | 347/46 |
| 6,010,203 | A * | 1/2000 | Muraki | 347/30 |
| 6,203,136 | B1 * | 3/2001 | Takahashi et al. | 347/32 |
| 6,217,146 | B1 * | 4/2001 | Takahashi et al. | 347/33 |
| 6,305,779 | B1 * | 10/2001 | Capurso et al. | 347/33 |
| 6,578,949 | B2 * | 6/2003 | Takahashi et al. | 347/30 |
| 6,726,306 | B2 * | 4/2004 | Keyes et al. | 347/32 |
| 6,951,381 | B2 * | 10/2005 | Shigeno et al. | 347/29 |
| 7,556,341 | B2 * | 7/2009 | Nozawa et al. | 347/29 |
| 7,717,540 | B1 * | 5/2010 | King et al. | 347/34 |
| 7,806,506 | B2 * | 10/2010 | Umeda | 347/29 |
| 7,883,174 | B2 * | 2/2011 | Wheeler | 347/29 |
| 7,980,677 | B2 * | 7/2011 | Chino et al. | 347/65 |
| 2001/0012029 | A1 * | 8/2001 | Momose | 347/30 |
| 2002/0036671 | A1 * | 3/2002 | Takahashi et al. | 347/29 |
| 2004/0155920 | A1 * | 8/2004 | Umeda et al. | 347/30 |
| 2005/0219308 | A1 * | 10/2005 | Nakashima | 347/29 |
| 2007/0064045 | A1 * | 3/2007 | Lim | 347/29 |
| 2007/0222829 | A1 * | 9/2007 | Stathem | 347/85 |
| 2008/0198207 | A1 * | 8/2008 | Katada | 347/85 |
| 2008/0238980 | A1 * | 10/2008 | Nagashima et al. | 347/17 |

(Continued)

FOREIGN PATENT DOCUMENTS

| | | | |
|---|---|---|---|
| JP | 06099584 | A * | 4/1994 |
| JP | 2009-029113 | A | 2/2009 |

*Primary Examiner* — Matthew Luu
*Assistant Examiner* — Patrick King
(74) *Attorney, Agent, or Firm* — Workman Nydegger

(57) ABSTRACT

A printer includes a fluid ejecting head having a plurality of nozzles, an ink supply channel and a maintenance device. The maintenance device includes a pressure regulating mechanism configured to reduce the pressures in the interiors of the ink supply channels at a position of pressure reduction, and a tight cap being brought into abutment with the fluid ejecting head so that the nozzle openings of the nozzles which receives a supply of ink through flow channels which are subject to relatively small pressure losses first by priority according to the magnitudes of the pressure losses in the respective flow channels extending from the position of pressure reduction to the respective nozzles.

14 Claims, 7 Drawing Sheets

(56) References Cited

U.S. PATENT DOCUMENTS

| | | | | |
|---|---|---|---|---|
| 2009/0009541 | A1 | 1/2009 | Shimazaki | |
| 2009/0179974 | A1* | 7/2009 | Kimura | 347/85 |
| 2009/0290002 | A1* | 11/2009 | Katoh | 347/85 |
| 2010/0020126 | A1* | 1/2010 | Takahashi | 347/30 |
| 2010/0085396 | A1* | 4/2010 | Yokota et al. | 347/7 |
| 2010/0245495 | A1* | 9/2010 | Katada et al. | 347/85 |
| 2011/0298865 | A1* | 12/2011 | Yamada et al. | 347/44 |

* cited by examiner 18
24
55
56
57
D1
D2
D3
25, 23
X
Y
FRONT
DOWN
RIGHT

MAINTENANCE DEVICE, FLUID EJECTING APPARATUS AND MAINTENANCE METHOD

CROSS REFERENCES TO RELATED APPLICATIONS

The entire disclosure of Japanese Patent Application No. 2010-119277, filed May 25, 2010 is expressly incorporated by reference herein.

BACKGROUND

1. Technical Field

The present invention relates to a maintenance device, a fluid ejecting apparatus, and a maintenance method.

2. Related Art

In the related art, ink jet printers are widely known as a fluid ejecting apparatus configured to eject fluid onto a medium. The ink jet printers are configured to perform a printing process onto the medium by ejecting ink (fluid) from nozzles formed on a fluid ejecting head.

Among the ink jet printers configured as described above, there is a printer including a cap member configured to cover the nozzles for restraining ink solvent from evaporating from nozzle openings when waiting for a printing operation or when the power is OFF (for example, JP-A-2009-29113).

When covering the nozzles with the cap member as describe above, it is preferable to close the nozzle openings by bringing the cap member into tight contact with the openings to reduce the amount of air communicating with the interiors of the nozzles in terms of restraint of evaporation. However, when the cap member comes into contact with the nozzle openings, the cap member comes into contact with liquid surfaces (meniscuses) of ink formed in the interiors of the nozzles, whereby meniscuses of a concave shape may be disadvantageously destructed.

Therefore, in the printer disclosed in JP-A-2009-29113, the contact between the cap member and the liquid surfaces is restrained by reducing the pressure in the interior of an ink flow channels and recessing the liquid surfaces into the nozzles when closing the nozzle openings by the cap member.

However, when a plurality of the nozzles are formed on the fluid ejecting head, timing of recessing the liquid surfaces or the extent of recession at the time of the pressure reduction may vary. Therefore, in the nozzles in which the recession of the liquid surfaces are not sufficient, the liquid surfaces and the cap member come into contact with each other, and the meniscuses formed therein are disadvantageously destructed.

SUMMARY

An advantage of some aspect of the invention is that there is provided a maintenance device, a fluid ejecting apparatus, and a maintenance method which are capable of closing nozzle openings of respective nozzles while restraining meniscuses formed in a plurality of the nozzles from being destructed.

According to a first aspect of the invention, there is provided a maintenance device for a fluid ejecting apparatus including a fluid ejecting head provided with a plurality of nozzles configured to eject fluid and fluid supply flow channels configured to supply the fluid toward the downstream side, which corresponds to the side of the fluid ejecting head, including: a pressure regulating mechanism configured to reduce the pressures in the fluid supply flow channels at a position of pressure reduction on the upstream side of the fluid ejecting head; and an abutting member configured to be brought into abutment with the fluid ejecting head after the pressure reduction by the pressure regulating mechanism has started, so that nozzle openings of the nozzles which receive a supply of the fluid through the flow channels which are subject to relatively small pressure losses are closed by priority according to the magnitudes of the pressure losses in the respective low channels extending from the position of pressure reduction to the respective nozzles.

In this configuration, when the pressure regulating mechanism performs the pressure reduction in the fluid supply flow channels, fluid in the nozzles can easily be recessed if the pressure losses in the flow channels are small, while the fluid in the nozzles can hardly be recessed if the pressure losses in the flow channels are large. Therefore, for the nozzles which are subject to small pressure losses in the flow channels and hence the liquid surfaces of which are easily recessed by the pressure reduction, flow of the fluid in the interiors of the nozzles can be restrained in a state in which the liquid surfaces are recessed by closing the nozzle openings thereof in advance. Also, by closing part of the nozzle openings which are subject to small pressure losses in the flow channels with the abutting member, the pressure dispersed to all the nozzles before closing can be concentrated to the nozzles which are subject to large pressure losses in the flow channels. Therefore, for the nozzles which are subject to small pressure losses in the flow channels and hence the liquid surfaces of which are hardly recessed by the pressure reduction, the liquid surfaces can be recessed without increasing the pressure reduction force of the pressure regulating mechanism. Accordingly, the liquid surfaces of all the nozzles can efficiently be recessed. Therefore, the nozzle openings of the respective nozzles can be closed while restraining the destruction of the meniscuses formed in the interiors of the plurality of nozzles.

Preferably, the abutting member closes the nozzle openings of the nozzle which receive the supply of the fluid though relatively short flow channels first by priority according to the lengths of the respective flow channels from the position of pressure reduction to the respective nozzles.

In this configuration, by closing the nozzle openings of the nozzles which receive the supply of fluid through the flow channels having relatively short lengths from the position of pressure reduction first by priority with the abutting member, the pressure can be concentrated to the nozzles having the long flow channels and hence the liquid surfaces of which can hardly be recessed by the pressure reduction to recess the liquid surfaces. Since the respective nozzle openings being closed as different timings can be closed with the same abutting member, it is not necessary to provide a plurality of the abutting members.

Preferably, the fluid supply flow channels each includes a storage portion extending along one direction for storing the fluid temporarily on the downstream side of the position of pressure reduction, an inflow hole configured to allow the fluid to flow into the storage portion, and a plurality of outflow holes arranged so as to be aligned along the one direction for supplying the fluid in the storage portion toward the respective nozzles, and the abutting member closes the nozzle openings of the nozzles which receive the supply of the fluid through the outflow holes located at shorter distances from the inflow hole first, and then closes the nozzle openings of the nozzles which receive the supply of the fluid through the outflow holes located at longer distances from the inflow hole.

In this configuration, since the storage portion is provided so as to extend along the one direction and the outflow holes are arranged so as to be aligned along the one direction, the pressure losses from the inflow hole to the outflow holes differ depending on the distances from the inflow hole to the outflow holes. Therefore, by closing the nozzle openings of the nozzles which receive the supply of fluid through the outflow holes located at the shorter distances from the inflow hole with the abutting member in advance, the positions of the liquid surfaces are prevented from excessively recessed. Then, subsequently, the pressure can be concentrated on the nozzles which are subject to the larger pressure losses to recess the liquid surfaces sufficiently before the nozzle openings of the nozzles which receive the supply of the fluid through the outflow holes located at the longer distances from the inflow hole are closed.

Preferably, the fluid supply flow channels further include an opening-and-closing valve which are capable of opening and closing the fluid supply flow channels at an opening and closing position on the upstream side of the position of pressure reduction.

In this configuration, when the pressure regulating mechanism performs the pressure reduction, the opening-and-closing valve positioned on the upstream side of the position of pressure reduction is brought into a closed state, so that the pressure reduction affects only the downstream side of the opening-and-closing valve.

Preferably, the nozzle openings of the plurality of nozzles are arranged so as to be aligned on one plane, and the abutting member is movable along the direction intersecting the one plane and includes an abutting surface which assumes, when part of the nozzle openings of the plurality of nozzles are closed, a position apart from the nozzles other than the part of nozzles which are closed.

In this configuration, the abutting member, being movable along the direction intersecting the one plane, can close the nozzle openings by moving in the direction toward the one plane, and can release the closing by moving in the direction away from the one plane. Since the abutting member has the abutment surface which assumes, when part of the nozzle openings of the plurality of nozzles are closed, a position apart from the nozzles other than the part of the plurality of nozzles, part of the nozzle openings can be closed selectively in the course of movement.

Preferably, the fluid ejecting head is provided with a nozzle row including a plurality of the nozzles, and the nozzle openings of the plurality of nozzles are arranged so as to be aligned on one plane, the abutting member is slidable with respect to the one plane along the direction of movement intersecting the direction of the nozzle row, and including an abutting portion for closing the nozzle opening and an opening provided at a position adjacent to the abutting portion, and the abutting member includes a first area having the abutting portion and the opening arranged so as to be aligned in the direction of the nozzle row, a second area having the opening arranged at a position adjacent to the first area in the direction of movement, and a third area having the abutting portion arranged at a position adjacent to the first area or the second area in the direction of movement.

In this configuration, By arranging the first area of the abutting member at a position corresponding to the nozzle row, only the nozzle openings located at positions corresponding to the abutting portions can be closed. Also, by arranging the second areas of the abutting member at a position corresponding to the nozzle row all the nozzle openings can be released from being closed. In addition, by arranging the third areas of the abutting member at a position corresponding to the nozzle row, all the nozzle openings can be closed. In other words, by changing the number of nozzle openings to be closed in association with the movement of the abutting member, part of the nozzle openings can be closed selectively.

According to a second aspect of the invention, there is provided a fluid ejecting apparatus including a fluid ejecting head provided with a plurality of nozzles for ejecting fluid; a fluid supply flow channel configured to supply the fluid toward the downstream side, which corresponds to the side of the fluid ejecting head; and the maintenance apparatus described above.

In this configuration, in addition to the similar effects and advantages to the above-describe maintenance device, by restraining the destruction of the meniscuses in association with the capping, ejection of fluid can be performed as soon as the abutting member is moved away from the nozzles.

According to a third aspect of the invention, there is provided a maintenance method including: starting a pressure reduction in the interior of a fluid supply flow channel configured to supply fluid toward the downstream side, which corresponds to the side of a fluid ejecting head having a plurality of nozzles for ejecting the fluid at a position of pressure reduction on the upstream side of the fluid ejecting head; after having started the pressure reduction, closing nozzle openings of part of nozzles which receive a supply of the fluid through flow channels which are subject to relatively small pressure losses according to the magnitudes of the pressure losses in the respective flow channels from the position of pressure reduction to the respective nozzles; and closing the nozzle openings of all the nozzles after the closing of the nozzle openings of part of the nozzles.

In this configuration, in the nozzles which are subject to the small pressure losses in the flow channels, the liquid surfaces are recessed by priority from the starting of the pressure reduction to the closing of the nozzle openings of part of the nozzles. However, by closing the corresponding nozzle openings in the closing of the nozzle openings of part of the nozzles, flow of the fluid in the interior of the nozzles can be restrained in a state in which the liquid surfaces are recessed. In addition, between the closing of the nozzle openings of part of the nozzles and the closing the nozzle openings of all the nozzles, the liquid surfaces can be recessed without increasing the pressure reduction force by concentrating the pressure onto the nozzles which are subject to the large pressure losses in the flow channel. Accordingly, the liquid surfaces in all the nozzles can efficiently be recessed. Therefore, the nozzle openings of the respective nozzles can be closed while restraining the destruction of the meniscuses formed in the plurality of nozzles.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
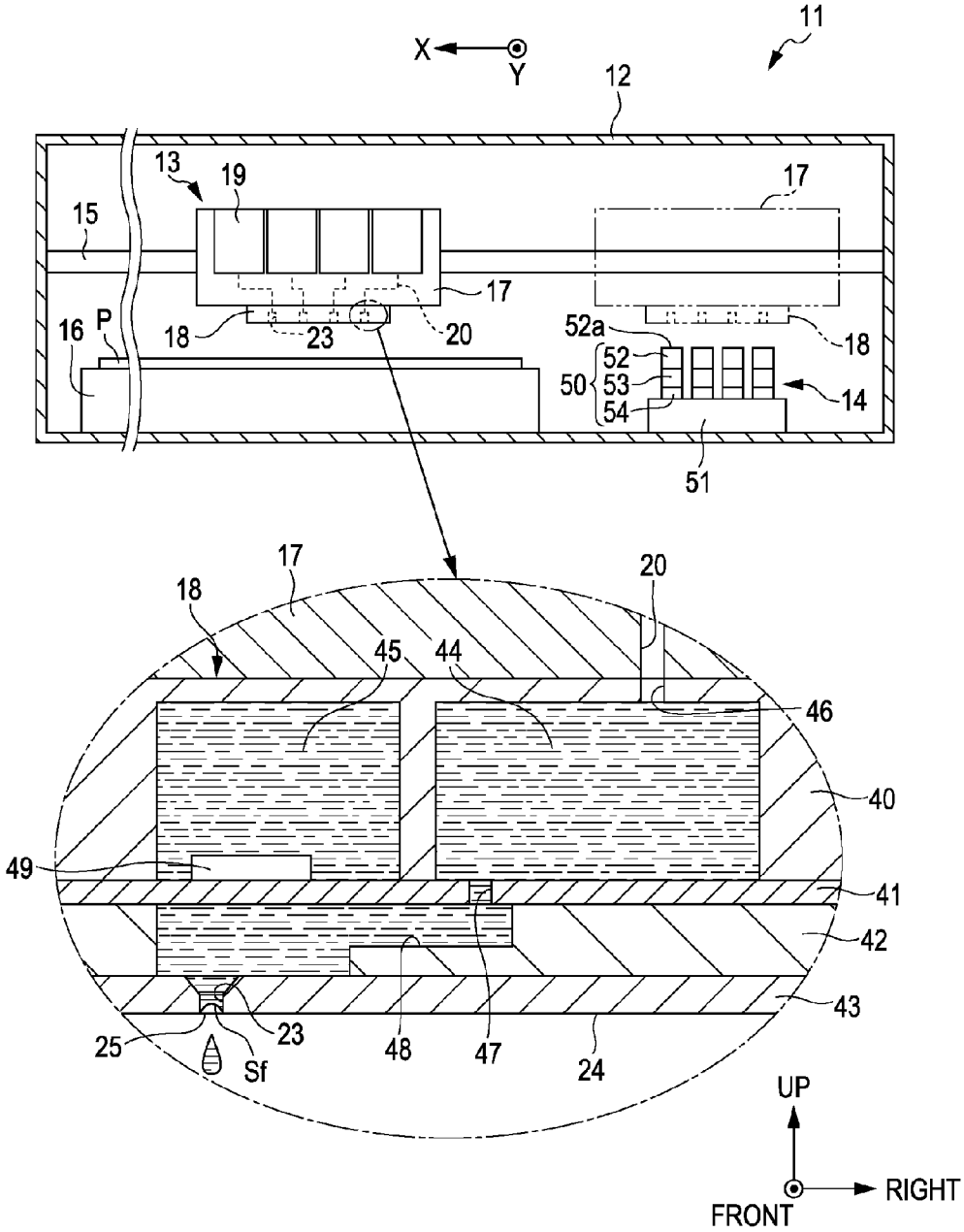
FIG. 1 is a cross-sectional view showing a schematic configuration of a printer according to a first embodiment.
Figure 2:
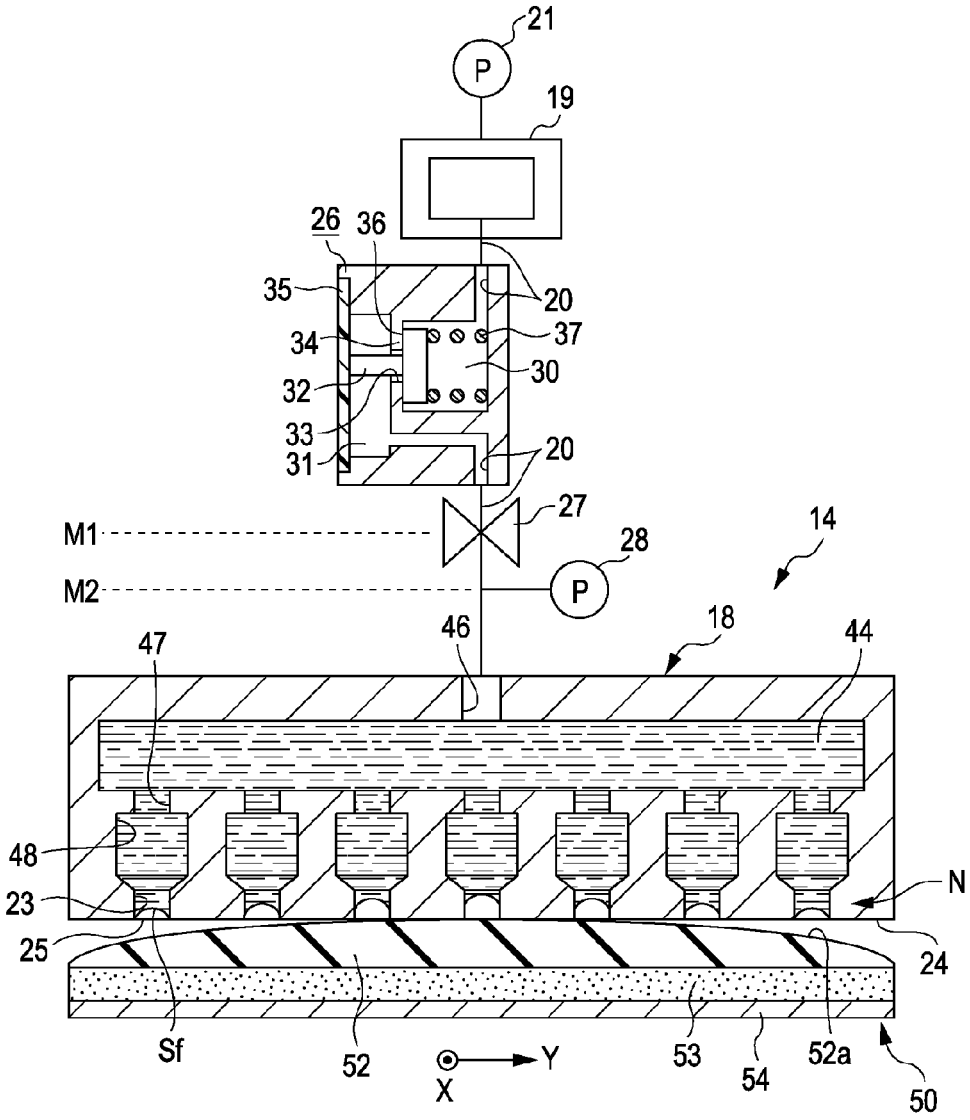
FIG. 2 is a cross-sectional view diagrammatically showing configurations of an ink supply channel, a fluid ejecting head, and a maintenance device.
Figure 3:
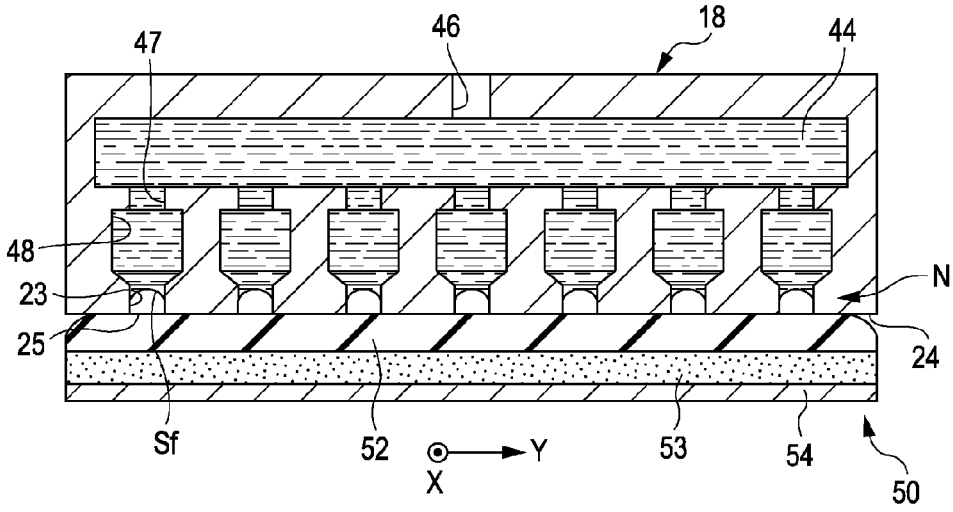
FIG. 3 is a cross-sectional view for explaining an operation of a cap member.

Referring now to FIG. 1 to FIG. 3, the invention will be described on the basis of a first embodiment in which an ink jet printer (hereinafter, referred to simply as "printer"), which is a type of fluid ejecting apparatuses. In the following description, "fore-and-aft direction", "lateral direction", and "vertical direction" indicate "front and back direction", "left and right direction", and "up and down direction" indicated by arrows in the drawings, respectively.

As shown in FIG. 1, a printer 11 as the liquid ejecting apparatus includes a body case 12, a recording unit 13 accommodated in the body case 12, and a maintenance device 14. In the body case 12, a rod-shaped guide shaft 15 extending in the lateral direction and a platen 16 for supporting a paper P as a medium are accommodated.

The recording unit 13 includes a carriage 17 supported by the guide shaft 15 in a state of being capable of reciprocating in the lateral direction, and a fluid ejecting head 18 supported on the side of a lower surface of the carriage 17. The carriage 17 is configured to be reciprocated in the lateral direction by a driving mechanism, not shown. In this embodiment, the right end side in the body case 12 is defined as a home position side, and a leftward direction from the home position side toward the left, which corresponds to a printing area, is illustrated as a direction of movement X.

The carriage 17 includes ink cartridges 19 having ink as fluid stored therein and demountably mounted thereon, and ink supply channels 20 as fluid supply flow channels for supplying ink toward a downstream side, which corresponds to the side of the fluid ejecting head 18. A plurality of the ink cartridges 19 and the ink supply channels 20 are provided corresponding to the number of colors (four in this embodiment).

The carriage 17 is provided with a booster pump 21 (see FIG. 2). When the booster pump 21 is driven, ink stored in the ink cartridges 19 is supplied to the downstream side through the ink supply channels 20. The booster pump 21 may be configured to supply a compressing force to the plurality of ink cartridges 19.

The fluid ejecting head 18 is provided with a plurality of nozzles 23 that eject the ink supplied through the respective ink supply channels 20, and a nozzle-formed surface 24 formed of a lower surface of the fluid ejecting head 18 is formed with a nozzle openings 25 of the nozzles 23. Paper P is transported onto the platen 16 from the back toward the front by a transporting mechanism, not shown. Ink drops are ejected from the nozzles 23 onto the paper P on the platen 16 while the carriage 17 moves (scans) linearly along the direction of movement X, so that printing (recording) is performed.

In the fluid ejecting head 18, the nozzles 23 corresponding to the respective colors are arranged along the direction of movement X and a plurality of the nozzles 23 that eject ink of the same color form a nozzle row N (see FIG. 2) extending along a direction of nozzle row Y which corresponds to the direction of transport of the paper P. In other words, the fluid ejecting head 18 includes a plurality of the nozzle rows N including a plurality of nozzles 23. With every scan of the carriage 17, printing across a width corresponding to the length of the nozzle row N is performed and the paper P is transported intermittently.

Subsequently, a configuration of the ink supply channel 20 will be described in detail.

As shown in FIG. 2, the ink supply channel 20 includes a differential pressure regulating valve 26 as a diaphragm-type self-sealing valve, and an opening-and-closing valve 27 configured to open and close the ink supply channel 20 at an opening-and-closing position M1 on the downstream side of the differential pressure regulating valve 26. Each of the ink supply channels 20 is provided with a pressure regulating mechanism 28 configured to reduce the pressure in the interior of each of the ink supply channels 20 at a position of pressure reduction M2 on the downstream side of the opening-and-closing position M1 and the upstream side of the fluid ejecting head 18. The opening-and-closing valve 27 and the pressure regulating mechanism 28 constitute the maintenance device 14.

A configuration of the differential pressure regulating valve 26 will be described here.

The differential pressure regulating valve 26 includes a storage chamber 30 configured to store ink compressed and supplied from the ink cartridge 19 temporarily, a pressure chamber 31 positioned on the downstream side of the storage chamber 30, and a valve element 32. The storage chamber 30 and the pressure chamber 31 are capable of communicating with each other via a communicating hole 33 provided on a partition 34 which partitions the both chambers. The storage chamber 30, the pressure chamber 31, and the communicating hole 33 constitute the ink supply channel 20.

Part of a wall surface of the pressure chamber 31 (a left wall in FIG. 2) is formed of a film 35 having flexibility. The valve element 32 is secured at one end thereof extending into the pressure chamber 31 to the film 35 at a position near the center thereof. The valve element 32 is configured to move between a valve-closing position where an abutting portion 36 stored in the storage chamber 30 closes the communicating hole 33 and a valve-opening position where the abutting portion 36 is apart from the communicating hole 33 in association with a flexure deformation of the film 35.

The storage chamber 30 accommodates a spring 37 configured to urge the valve element 32 in a valve-closing direction (leftward in FIG. 2) from the valve-opening position toward the valve-closing position in the interior thereof. The storage chamber 30 and the pressure chamber 31 communicates with each other by the movement of the valve element 32 in a valve-opening direction (rightward in FIG. 2) from the valve-closing position to the valve-opening position against an urging force of the spring 37.

Then, when ink is ejected from the nozzles 23, the ink flows out from the interior of the pressure chamber 31, so that a negative pressure is generated, whereby the film 35 is subject to flexure displacement in the direction of reducing a capacity of the pressure chamber 31 (rightward in FIG. 2) by a differential pressure between an ink pressure in the interior of the pressure chamber 31 and the atmospheric pressure. When this flexure force exceeds the urging force of the spring 37, the valve element 32 is moved to the valve-opening position and the ink in the compressed storage chamber 30 flows into the pressure chamber 31.

When the negative pressure is cancelled by the inflow of the ink into the pressure chamber 31, the valve element 32 is moved again to the valve-closing position by the urging force of the spring 37. In this manner, the differential pressure regulating valve 26 is configured to supply ink according to the amount of consumption by opening and closing on the basis of the differential pressure between the ink pressure and the atmospheric pressure.

The urging force of the spring 37 is adjusted so that the differential pressure regulating valve 26 opens when the pressure in the interior of the pressure chamber 31 underruns a pressure of approximately −1 kPa. In other words, the differential pressure regulating valve 26 has a pressure regulating function for keeping the interior of the ink supply channel 20 on the downstream side of the communicating hole 33 at a negative pressure on the order of −1 kPa.

The opening-and-closing valve 27 provided on the downstream side of the differential pressure regulating valve 26 is a valve which can be arbitrarily opened and closed. An electromagnetic valve or a mechanically operated valve may be employed as the opening-and-closing valve 27.

The pressure regulating mechanism 28 is a pressure reducing pump having a function to reduce the pressure in the interior of the ink supply channel 20. Preferably, the pressure reducing pump has a configuration to reduce the pressure by sucking a certain amount of ink from the interior of the ink supply channel 20 and release the reduced pressure by returning the sucked ink into the ink supply channel 20. A piston pump or a tube pump can be employed as the pressure regulating mechanism 28. Then, when the pressure regulating mechanism 28 performs the pressure reduction, the opening-and-closing valve 27 positioned immediately on the upstream side is brought into a closed state to close the ink supply channel 20, so that the pressure reduction affects only the downstream side of the opening-and-closing valve 27.

Subsequently, a configuration of the fluid ejecting head 18 will be described in detail.

As shown in a partly enlarged cross-sectional view in FIG. 1, the fluid ejecting head 18 includes a flow channel containing member 40, a diaphragm 41, a flow channel containing member 42, and a nozzle plate 43 laminated in the vertical direction.

The flow channel containing member 40 is formed with a reservoir 44 as a storage portion and a storage chamber 45. The flow channel containing member 40 is also formed with an inflow hole 46 for allowing ink to flow into the interior of the reservoir 44. The diaphragm 41 is provided with a plurality of outflow holes 47 for supplying ink in the reservoir 44 toward the respective nozzles 23.

As shown in FIG. 2, the reservoir 44 is provided so as to extend in one direction (the direction of nozzle row Y) for storing ink temporarily on the downstream side of the pressure regulating mechanism 28. The inflow hole 46 is provided on the reservoir 44 at a position near the center in the direction of nozzle row Y, and the plurality of outflow holes 47 are arranged so as to be aligned along the direction of nozzle row Y. In the illustrations of respective drawings from FIG. 2 onward, the numbers of the nozzles 23 and the outflow holes 47 which constitute the respective nozzle rows N are omitted for simplicity.

As shown in FIG. 1, the flow channel containing member 42 is formed with cavities 48 communicating with the reservoir 44 via the outflow holes 47. Piezoelectric elements 49 are disposed in the storage chamber 45 on the upper surface of the diaphragm 41 at positions above the cavities 48.

The nozzle plate 43 is formed with nozzles 23 communicating with the cavities 48 so as to penetrate therethrough. The nozzle-formed surface 24 of the fluid ejecting head 18 is formed of a lower surface (bottom surface) of the nozzle plate 43. In other words, the nozzle openings 25 of the nozzles 23 are arranged so as to be aligned on the nozzle-formed surface 24 as one plane.

The diaphragm 41 is adhered so as to be capable of vibrating in the vertical direction, and the piezoelectric elements 49 are configured to cause the diaphragm 41 to vibrate in the vertical direction by expanding and contracting upon receipt of a drive signal. When the diaphragm 41 vibrates in the vertical direction, the capacities of the cavities 48 are expanded and contracted. When the capacities of the cavities 48 are contracted, ink in the cavities 48 are ejected as ink drops from the nozzles 23.

When the ink drops are ejected from the nozzles 23, the nozzles 23 are refilled with ink from the interiors of the cavities 48 by a capillary force. In other words, ink supplied from the ink cartridges 19 into the fluid ejecting head 18 through the ink supply channels 20 is stored in the reservoir 44 once, and then is supplied from the reservoir 44 to the respective nozzles 23 through the outflow holes 47 and the cavities 48. In this embodiment, the inflow hole 46, the reservoir 44, the outflow holes 47, and the outflow holes 47 constitute parts of the ink supply channels 20.

The interiors of the nozzles 23 are formed to have a high affinity (wettability) to ink. The pressure in the area in the fluid ejecting head 18 (in the interiors of the ink supply channels 20), which corresponds to a back pressure of the nozzles 23 is maintained to a negative pressure on the order of −1 kPa by the pressure regulating function of the differential pressure regulating valve 26 on a steady basis. This back pressure prevents ink from running down from the nozzles 23 and forms meniscuses uniformly in the respective nozzles to stabilize the ejecting action.

Therefore, a liquid surface Sf of ink in each of the nozzles 23 forms a meniscus in a concave shape clipped along a periphery thereof at a boundary portion (nozzle opening) between the nozzle-formed surface 24 and the nozzle 23 and recessed at a portion near the center thereof toward the upstream side. The term "meniscus" here means a curved fluid surface caused when fluid (ink) comes into contact with the surface of a solid body by a magnitude relation between intermolecular attractive force therebetween and intermolecular aggregation of the fluid.

Subsequently, the maintenance device 14 will be described.

As shown in FIG. 1 and FIG. 2, the maintenance device 14 includes tight caps 50 as abutting members which come into abutment with the fluid ejecting head 18 so as to close the nozzle openings 25 of the respective nozzles 23 for each nozzle row N which ejects ink of the same color.

The maintenance device 14 is provided with an elevating mechanism 51 (see FIG. 1) configured to move the respective tight caps 50 in the vertical direction. In this configuration, the tight caps 50 are movable in the vertical direction. The tight caps 50 each include a rubber member 52 having an abutment surface 52*a* for closing the nozzle openings 25 formed on an upper surface thereof, a sponge member 53 configured to support the rubber member 52 from below, and a base portion 54 arranged between the sponge member 53 and the elevating mechanism 51.

As shown in FIG. 2, the abutment surface 52*a* of each of the tight caps 50 is formed into a convex surface swelled at a center thereof in the direction of nozzle row Y. Therefore, when the tight caps 50 close part of a plurality of the nozzle openings 25 positioned near the center thereof from among those arranged in the direction of nozzle row Y, the tight caps 50 are positioned apart from the nozzles 23 other than the nozzles 23 closed thereby, that is, from the nozzles arranged near the both ends.

Subsequently, tight capping using the tight caps 50 will be described.

When printing is finished, the carriage 17 moves rightward from the printing area on the platen 16, and stops at a home position above the tight caps 50. Then, in order to restrain ink solvent from evaporating from the nozzle openings 25, tight capping which closes the nozzle openings 25 of the nozzles 23 with the tight caps 50 is performed.

The tight capping is performed by the elevating mechanism 51 moving the tight caps 50 upward toward the fluid ejecting head 18 stopped at a home position. More specifically, the base portion 54 is moved upward by the elevating mechanism 51. At this time, the tight caps 50 move from a position where the abutment surfaces 52*a* are apart from the nozzle-formed surface 24 to a position where the abutment surfaces 52*a* close all the nozzle openings 25 aligned in the direction of nozzle row Y as shown in FIG. 3.

After having completed the movement of the tight caps 50, the rubber members 52 are resiliently deformed, and the abutment surfaces 52*a* come into tight contact with the nozzle-formed surface 24 including the nozzle openings, and assume a state of being urged by a restoration force of the contractionally deformed sponge members 53. Accordingly, the nozzle openings 25 of the nozzles 23 are closed and are brought into a substantially closed state.

Since the liquid surfaces Sf of the ink in the nozzles 23 are clipped along the peripheries thereof to the nozzle openings, if the tight caps 50 come into abutment with the nozzle openings, the tight caps 50 may come into contact with the liquid surfaces Sf, thereby destructing the meniscuses formed in the nozzles 23. Therefore, when performing the tight capping, it is necessary to recess the liquid surfaces Sf to the upstream side by reducing the pressures in the interiors of the ink supply channels 20 by the pressure regulating mechanism 28 so as to avoid the contact of the tight caps 50 with the liquid surfaces Sf.

However if the magnitude of the pressure losses differs from one flow channel to another, which extend from the position of pressure reduction M2 where the pressure regulating mechanism 28 performs the pressure reduction to the respective nozzles 23, transfer of the pressures into the interiors of the respective nozzles fluctuates. For example, because of a positional relationship among the inflow hole 46, the reservoir 44, and the respective outflow holes 47, the lengths of the flow channels from the pressure regulating mechanism 28 to the respective nozzles 23 differ depending on the distances from the inflow hole 46 to the outflow holes 47.

In other words, the magnitudes of the pressure losses of the respective flow channels extending from the pressure regulating mechanism 28 to the receptive nozzles 23 vary according to the distances from the inflow hole 46 to the outflow holes 47. Therefore, as shown in FIG. 2, the nozzles 23 near the both ends which receive a supply of ink through the outflow holes 47 located at the longer distances from the inflow hole 46 are subject to larger pressure losses in the flow channels than those near the center which receive the supply of ink through the outflow holes 47 located at the shorter distances from the inflow hole 46, and are less affected by the pressure reduction. In other words, ink in the nozzles 23 near the center which are subject to the smaller pressure losses in the flow channels is easily recessed, while ink in the nozzles 23 near the both ends which are subject to the larger pressure losses in the flow channels is hardly recessed by the pressure reduction. Consequently, even when the pressure reduction are performed for all the nozzles 23, the positions of the liquid surfaces Sf are not recessed sufficiently to the upstream side near the both ends.

In order to release the clipping along the peripheries to recess the liquid surfaces Sf, a force larger than a force for moving the liquid surfaces Sf on a flat portion is required. Therefore, if the pressure reduction is not sufficient for releasing the clipping, the negative pressures in the nozzles 23 increase. Then, when the tight caps 50 come into contact with the liquid surfaces Sf in the nozzles 23 in which the negative pressures are increased, ink may be drawing out by the tight caps 50 or, simultaneously, air bubbles may be taken into the nozzles 23.

Accordingly, in this embodiment, after the pressure reduction by the pressure regulating mechanism 28 has started, the tight caps 50 are bought into abutment with the fluid ejecting head 18 so that the nozzle openings 25 of the nozzles 23 which receive the supply of ink through the flow channels which are subject to relatively small pressure losses are closed by priority according to the magnitudes of the pressure losses in the respective flow channels extending from the position of pressure reduction M2 to the respective nozzles 23.

More specifically, first of all, the opening-and-closing valve 27 is brought into an opened state as a valve-closing step. Subsequently, the pressure reduction by the pressure regulating mechanism 28 is started as a pressure reduction starting step. Accordingly, the back pressures of the respective nozzles 23 are lowered, so that the liquid surfaces Sf of the nozzles 23 which are subject to the smaller pressure losses in the flow channels extending from the position of pressure reduction M2 to the respective nozzles 23 and hence are easy to reduce the pressure are recessed by priority.

Subsequently, the tight caps 50 are moved continuously upward at a constant speed as a moving step. Accordingly, the nozzle openings 25 of the plurality of nozzles 23 which constitute the nozzle row N are closed in sequence from the center side toward the both ends. In other words, the tight caps 50, each having the convex curved abutment surface 52*a* formed into a convex curved surface, close the nozzle openings 25 of the nozzles 23 which receive the supply of ink through the outflow holes 47 located at the shorter distances from the inflow hole 46 first, and then close the nozzle openings 25 of the nozzles 23 which receive the supply of ink through the outflow holes 47 located at the longer distances from the inflow hole 46. Consequently, according to the lengths of the flow channels extending from the position of pressure reduction M2 to the respective nozzles 23, the nozzle openings 25 of the nozzles 23 which receive the supply of fluid through the relatively short flow channels are closed first by priority.

Since flow of ink in is restricted in the interior of the nozzles 23 whose nozzle openings 25 are closed by the nozzle openings 25 by the tight caps 50, the rising of the liquid surfaces Sf is restricted even when the pressure reduction is continued. By continuing the pressure reduction by the pressure regulating mechanism 28 after the tight caps 50 have closed the nozzle openings 25 near the center, the liquid surfaces Sf formed in the nozzles 23 near the both ends which are not closed are recessed intensively toward the upstream side.

In order to retain the positions of the liquid surfaces Sf in the nozzles 23, the amount of ink to be sucked by the pressure regulating mechanism 28 (pressure reduction pump) from the interior of the ink supply channels 20 are preferably set so as to correspond to a total capacity of all the nozzles 23. Then, when the tight cap 50 end the upward movement and close all the nozzle openings 25, the tight capping is completed.

When restarting the printing, the pressure reduction by the pressure regulating mechanism 28 is released, and then the tight caps 50 are moved downward. Also, the opening-and-closing valve 27 is brought into the opened sate. Then, the pressures in the areas in the fluid ejecting head 18 (in the interior of the ink supply channels 20) are returned to a negative pressure on the order of −1 kPa, and the positions of the liquid surfaces Sf in the nozzles 23 are also restored. Accordingly, quick printing operation can be started as soon as the closing of the nozzle openings 25 is released.

According to the embodiment described thus far, the following effects are achieved.

(1) When the pressure regulating mechanism 28 performs the pressure reduction in the ink supply channels 20, ink in the nozzles 23 can easily be recessed if the pressure losses in the flow channels are small, while the ink in the nozzles 23 can hardly be recessed if the pressure losses in the flow channels are large. Therefore, for the nozzles 23 which are subject to the small pressure losses in the flow channels and hence the liquid surfaces Sf of which are easily recessed by the pressure reduction, flow of the ink in the interiors of the nozzles 23 can be restrained in a state in which the liquid surfaces Sf are recessed by closing the nozzle openings 25 thereof in advance. Also, by closing part of the nozzle openings 25 which are subject to the small pressure losses in the flow channels with the tight cap 50, the pressure dispersed to all the nozzles before closing can be concentrated to the nozzles 23 which are subject to the large pressure losses in the flow channels. Therefore, for the nozzles 23 which are subject to the small pressure losses in the flow channels and hence the liquid surfaces Sf of which are hardly recessed by the pressure reduction, the liquid surfaces Sf can be recessed without increasing the pressure reduction force of the pressure regulating mechanism 28. Accordingly, the liquid surfaces Sf of all the nozzles 23 can efficiently be recessed. Therefore, the nozzle openings 25 of the respective nozzles 23 can be closed while restraining the destruction of the meniscuses formed in the plurality of nozzles 23. Then, by restraining the destruction of the meniscuses in association with the tight capping, ejection of ink can be performed as soon as the tight caps 50 are moved away from the nozzles 23.

(2) By closing the nozzle openings 25 of the nozzles 23 which receive the supply of ink through the flow channels having relatively short lengths from the position of pressure reduction M2 first by priority with the tight cap 50, the pressure can be concentrated to nozzles 23 having the long flow channels and hence the liquid surfaces Sf of which can hardly be recessed by the pressure reduction to recess the liquid surfaces Sf. Since the respective nozzle openings 25 being closed as different timings can be closed with the same tight caps 50, it is not necessary to provide a plurality of the tight caps 50 for the nozzle row N used for the ejection of ink of the same color.

(3) Since the reservoir 44 is provided so as to extend along the direction of nozzle row Y and the outflow holes 47 are arranged so as to be aligned along the direction of nozzle row Y, the pressure losses from the inflow hole 46 to the outflow holes 47 differ depending on the distances from the inflow hole 46 to the outflow holes 47. Therefore, by closing the nozzle openings 25 of the nozzles 23 which receive the supply of ink through the outflow holes 47 located at the shorter distances from the inflow hole 46 with the tight caps 50 in advance, the positions of the liquid surfaces Sf are prevented from excessively recessed. Then, subsequently, the pressure can be concentrated on the nozzles 23 which are subject to the larger pressure losses to recess the liquid surfaces Sf sufficiently before the nozzle openings 25 of the nozzles 23 which receive the supply of the ink through the outflow holes 47 located at longer distances from the inflow hole 46 are closed.

(4) When the pressure regulating mechanism 28 performs the pressure reduction, the opening-and-closing valve 27 positioned on the upstream side of the position of pressure reduction M2 is brought into a closed state, so that the pressure reduction affects only the downstream side of the opening-and-closing valve 27.

(5) The tight cap 50, being movable along the vertical direction, can close the nozzle openings 25 by moving upward toward the nozzle-formed surface 24, and can release the closing by moving downward away from the nozzle-formed surface 24. Since the tight caps 50 each have the abutment surface 52*a* which assumes a position apart from the nozzles 23 other than the part of the plurality of nozzles 23 when part of the nozzle openings 25 of the plurality of nozzles 23 are closed, part of the nozzle openings 25 can be closed selectively in the course of movement.

(6) By moving the tight caps 50 having the abutment surfaces 52*a* formed into the convex curved surface swelling at the center thereof upward, the nozzle openings 25 can be closed in sequence from the center side toward the both ends in the direction of nozzle row Y without the necessity of complex control.

(7) The pressure regulating mechanism 28 performs the pressure reduction by sucking a certain amount of ink corresponding to the total capacity of all the nozzles 23 from the interiors of the ink supply channels 20, and releases the pressure reduction by returning the sucked ink into the interior of the ink supply channels 20. Therefore, ink is not consumed in association with the pressure regulation and the positions of the liquid surfaces Sf can be restored by releasing the pressure reduction.

Second Embodiment

Subsequently, referring now to FIG. 4 and FIG. 5, a second embodiment of the invention will be described. The second embodiment is different from the first embodiment in part of the configuration of the maintenance device 14. Therefore, in the description given below, different parts from the first embodiment will mainly be descried, and the same or corresponding components to the first embodiment are designated by the same reference numerals and overlapped descriptions are omitted.

Figure 4:
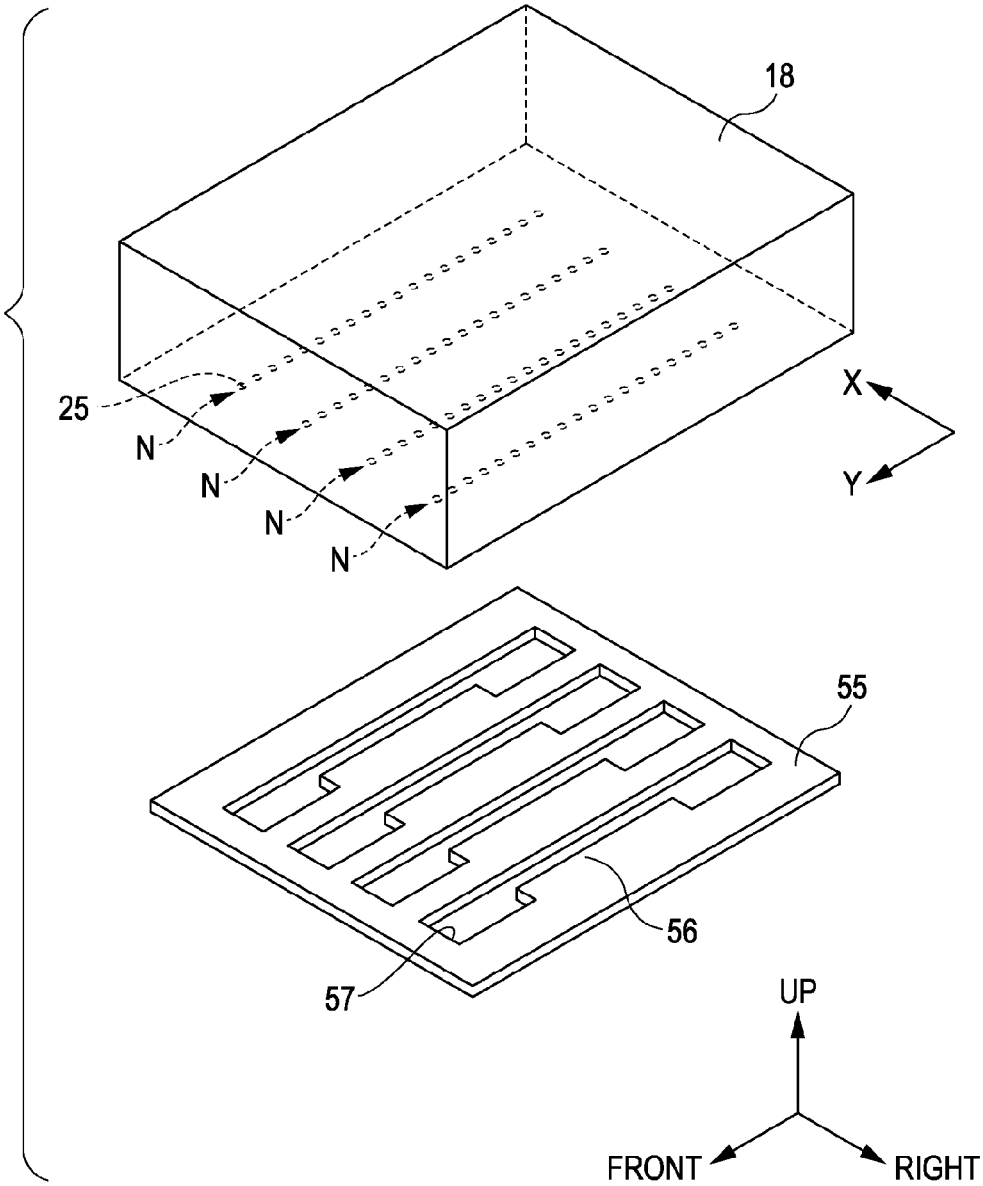
FIG. 4 is a perspective view of a cap member according to a second embodiment.

As shown in FIG. 4, the maintenance device 14 in this embodiment includes a substantially flat-panel shaped tight cap 55 which is movable in the vertical direction by a moving mechanism, not shown, and is slidable with respect to the nozzle-formed surface 24 along the direction of movement X. The tight cap 55 includes abutting portions 56 for closing the nozzle openings 25, and openings 57 provided at positions adjacent to the abutting portion 56 for exposing the nozzle openings 25.

Figures 5A, 5B, 5C:
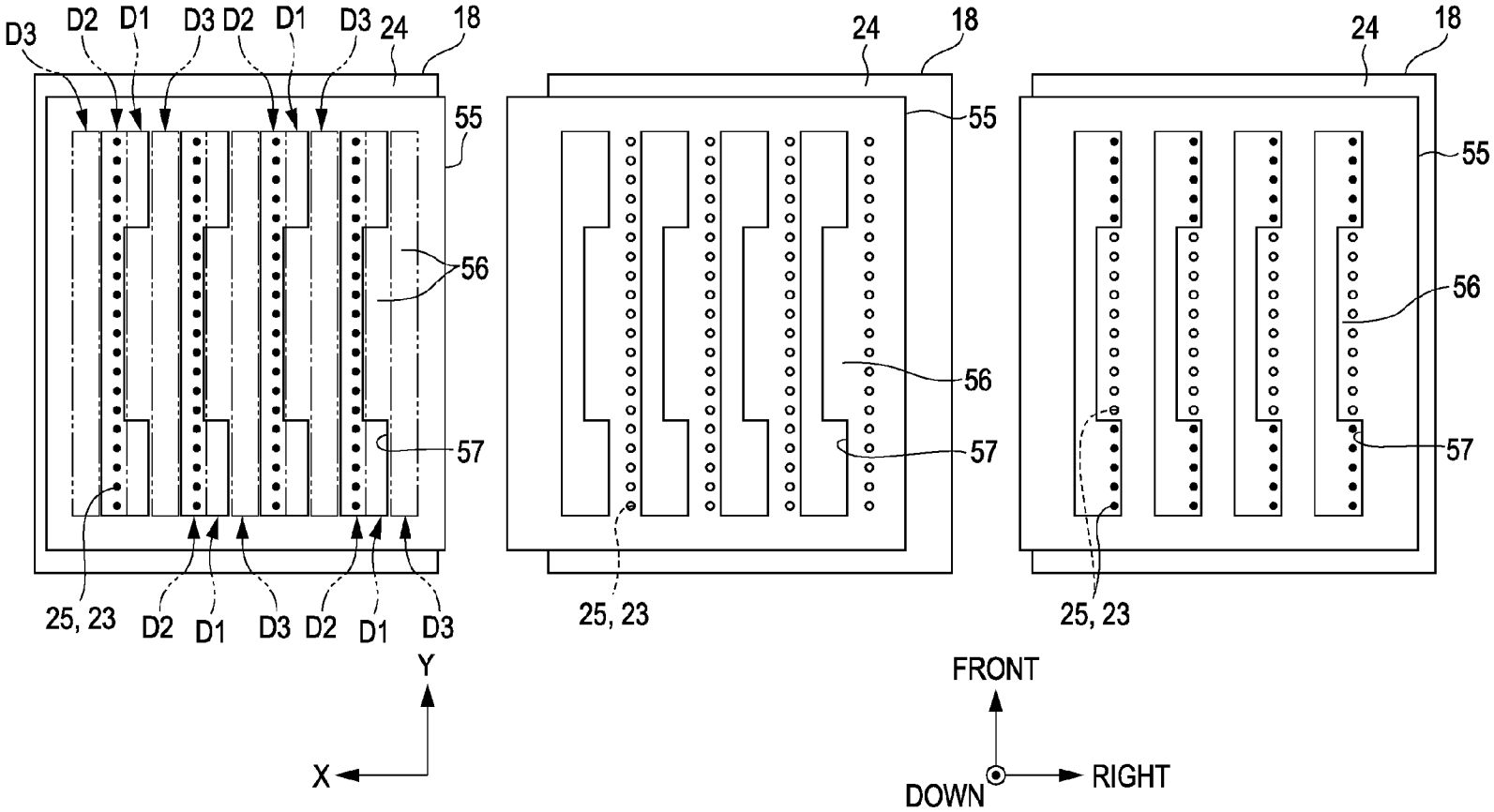
FIGS. 5A to 5C are bottom views for explaining a configuration and an operation of the cap member.

As shown in FIGS. 5A, 5B, and 5C, a plurality of the abutting portions 56 and the openings 57 extend in the direction of nozzle row Y so as to corresponds to the respective nozzle rows N for ejecting the inks in the same colors, and are arranged so as to be aligned along the direction of movement X which is the direction of relative movement between the tight cap 55 and the fluid ejecting head 18. In FIG. 5, the nozzles 23 (the nozzle openings 25) communicated with the atmospheric air by being exposed through the openings 57 are illustrated by solid circles, while the nozzle openings 25 (the nozzles 23) close by the abutting portions 56 are illustrated by hollow circles.

As shown in FIG. 5A, the tight cap 55 is provided with areas D1 as first areas each including the abutting portion 56 and the openings 57 arranged so as to be aligned in the direction of nozzle row Y. The tight cap 55 is also provided with areas D2 as second areas each including only the opening 57 arranged at positions adjacent to the areas D1 on both sides, and areas D3 as third areas each including only the abutting portion 56. In FIG. 4 and FIGS. 5B and 5C, illustration of boundary lines between the areas D1 to D3 illustrated by alternate long and two short dashes lines in FIG. 1 is omitted.

The openings 57 are provided for each nozzle row N which ejects ink of the same color. The openings 57 in the area D1 and the area D2 are integrally formed, and the abutting portions 56 of the area D1 and the area D3 are integrally formed.

The areas D3 are arranged on both sides of the openings 57 in the direction of movement X. Accordingly, all the nozzle openings 25 can be closed quickly from the state in which the nozzles 23 communicate with the atmospheric air through the openings 57 of the areas D1 or the areas D2 irrespective of whether the tight cap 55 is moved leftward or rightward.

In each of the areas D1, the abutting portion 56 is provided near the center in the direction of nozzle row Y, while the openings 57 are provided near both ends in the direction of nozzle row Y. Therefore, the abutting portions 56 in the areas D1 are configured to close the nozzles 23 which receive the supply of ink through the outflow holes 47 located at shorter distances from the inflow hole 46, that is, the nozzle openings 25 of the nozzles 23 which receive the supply of ink through the flow channels which are subject to a relatively small pressure loss. In the area D1, the number of nozzles 23 which are covered by the abutting portions 56 near the center and the openings 57 near the both ends in each of the areas D1 can be changed arbitrarily.

The tight cap 55 closes all the nozzle openings 25 which constitute the nozzle rows N by coming into abutment with the nozzle-formed surface 24 so that the areas D3 are arranged under the nozzle rows N as shown in FIG. 5B. Also, the tight cap 55 brings all the nozzle openings 25 which constitute the nozzle rows N into communication with the atmospheric air by coming into abutment with the nozzle-formed surface 24 so that the areas D2 are arranged under the nozzle rows N as shown in FIG. 5A.

Also, the tight cap 55 closes all the nozzle openings 25 near the center in the direction of nozzle row Y and, in contrast, brings the nozzles 23 located near the both ends into communication with the atmospheric air by coming into abutment with the nozzle-formed surface 24 so that the areas D1 are arranged below the nozzle rows N as shown in FIG. 5C. In other words, the tight cap 55 includes the openings 57 which expose part of the nozzle openings 25 when other parts of nozzle openings 25 of the plurality of nozzles 23 are closed.

Then, at the time of tight capping, after having opened the opening-and-closing valve 27 as the valve closing step, the tight cap 55 is brought into abutment with the nozzle-formed surface 24 so that the areas D2 are arranged below the respective nozzle rows N as shown in FIG. 5A. Subsequently, the pressure reduction by the pressure regulating mechanism 28 is started as the pressure reduction starting step.

Also, after having elapsed a predetermined time, the tight cap 55 is slid in the direction of movement X (leftward direction) while keeping in sliding contact with the nozzle-formed surface 24 as the first closing step, the areas D2 of the tight cap 55 are arranged below the nozzle rows N as shown in FIG. 5C.

At this time, according to the lengths of the flow channels extending from the position of pressure reduction M2 to the respective nozzles 23, the nozzle openings 25 of the nozzles 23 which receive the supply of ink through the relatively short flow channels are closed by the abutting portions 56 of the areas D1 by priority. Accordingly, since flow of ink is restricted in the interiors of the nozzles 23 whose nozzle openings 25 are closed by the tight cap 55, the positions of the liquid surfaces Sf are not raised any longer even when the pressure reduction is continued. By continuing the pressure reduction by the pressure regulating mechanism 28 after the tight cap 55 has closed the nozzle openings 25 of the nozzles 23 near the center, the liquid surfaces Sf formed in the nozzles 23 near the both ends whose nozzle openings 25 are not closed are recessed intensively toward the upstream side.

Then, after having elapsed a predetermined time from the first closing step, the tight cap 55 is moved further in the direction of movement X to arrange the areas D3 of the tight cap 55 below the nozzle rows N as shown in FIG. 5B, so that the nozzle openings 25 of all the nozzles 23 are closed as a second closing step.

According to the embodiment described above, the following effects are obtained in addition to the effects and advantages as described in (1) to (4) and (7).

(8) In the nozzles 23 which are subject to the small pressure losses as in the flow channels, the liquid surfaces Sf are recessed by priority in a period from the pressure reduction starting step to the first closing step. However, by closing the corresponding nozzle openings 25 in the first closing step, flow of the ink in the interior of the nozzles 23 can be restrained in a state in which the liquid surfaces Sf are recessed. In addition, in the period from the first closing step to the second closing step, the liquid surfaces Sf can be recessed without increasing the pressure reduction force by concentrating the pressure onto the nozzles 23 which are subject to the large pressure losses in the flow channel. Accordingly, the liquid surfaces Sf in all the nozzles 23 can efficiently be recessed. Therefore, the nozzle openings 25 of the respective nozzles 23 can be closed while restraining the destruction of the meniscuses formed in the plurality of nozzles 23.

(9) By arranging the areas D1 of the tight cap 55 at positions corresponding to the nozzle rows N, only the nozzle openings 25 located at positions corresponding to the abutting portions 56 can be closed. Also, by arranging the areas D2 of the tight cap 55 at positions corresponding to the nozzle rows N, all the nozzle openings 25 can be released from being closed. In addition, by arranging the areas D3 of the tight cap 55 at positions corresponding to the nozzle rows N, all the nozzle openings 25 can be closed. In other words, by changing the number of nozzle openings 25 to be closed in association with the movement of the tight cap 55 along the direction of movement X, part of the nozzle openings 25 can be closed selectively.

The embodiments described above may be modified as follows.

Figure 6:
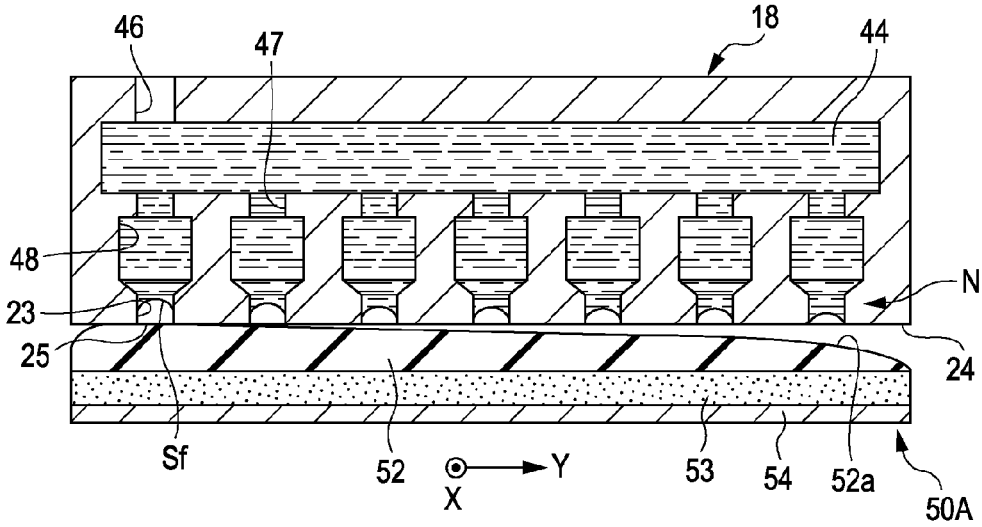
FIG. 6 is a cross-sectional view showing a first modification of the first embodiment.

In the first embodiment, as shown in a first modification in FIG. 6, when the inflow hole 46 is provided on one end side (the rear side which corresponds to the left end side in FIG. 6) of the reservoir 44 in the direction of nozzle row Y, the lengths of the flow channels from the inflow hole 46 to the outflow holes 47 are shorter on the one end side, and longer on the other end side (the front side which corresponds to the right end side in FIG. 6). In this case, a tight cap 50A having an abutment surface 52*a* which inclines obliquely downward from the one end side to the other end side may be provided. Accordingly, when the abutment surface 52*a* of the tight cap 50A closes the nozzle openings 25 on one end side, the abutment surface 52*a* of the tight cap 50A assumes a position apart from the nozzles 23 on the other end side.

Figure 7:
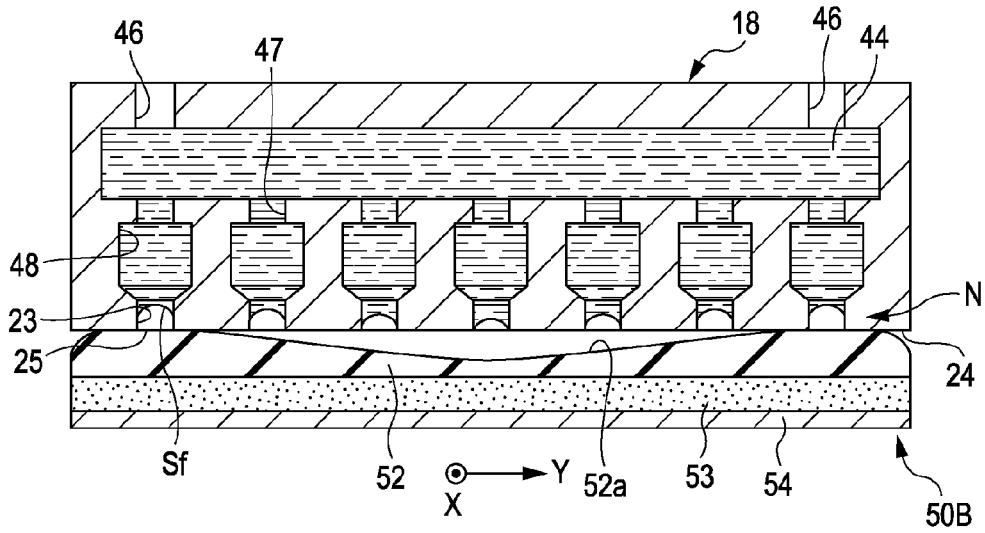
FIG. 7 is a cross-sectional view showing a second modification of the first embodiment.

In the first embodiment, as shown in a second modification in FIG. 7, when the inflow hole 46 is provided on both end sides of the reservoir 44 in the direction of nozzle row Y, the lengths of the flow channels from the inflow hole 46 to the outflow holes 47 are shorter on the both end sides, and longer near the center. In this case, a tight cap 50B including an abutment surface 52*a* having a concave curved surface which inclines obliquely downward from the both end sides to near the center may be provided. Accordingly, the abutment surface 52*a* of the tight cap 50B assumes a position apart from the nozzles 23 near the center when closing the nozzle openings 25 on both end sides.

In the first embodiment, the tight cap 50 may be moved upward intermittently more than once. In this case, after the pressure reduction starting step for starting the pressure reduction in the ink supply channels 20, the nozzle openings 25 of the nozzles 23 which receive the supply of ink through the flow channels which are subject to relatively small pressure losses are closed in the first closing step in association with the first movement. In the second closing step in association with the second movement, all the nozzle openings 25 are closed by closing the nozzle openings 25 of the nozzles 23 which receive the supply of ink through the flow channels which are subject to relatively large pressure losses. Accordingly, the effects and advantages as described in (8) are obtained.

Incidentally, even when the tight caps 50 are continuously moved upward at a constant speed as in the first embodiment, the similar effects and advantages as in (8) are applied if a portion from the start of movement to an arbitrary midpoint is defined to be a first closing step and a portion from the midpoint to the end of the movement is defined as the second closing step.

In the first embodiment, the nozzle openings 25 of all the nozzles 23 (the nozzle row N) may be closed with one single tight cap 50.

In the first embodiment, the tight cap 50 may not have the sponge member 53.

Figure 8:
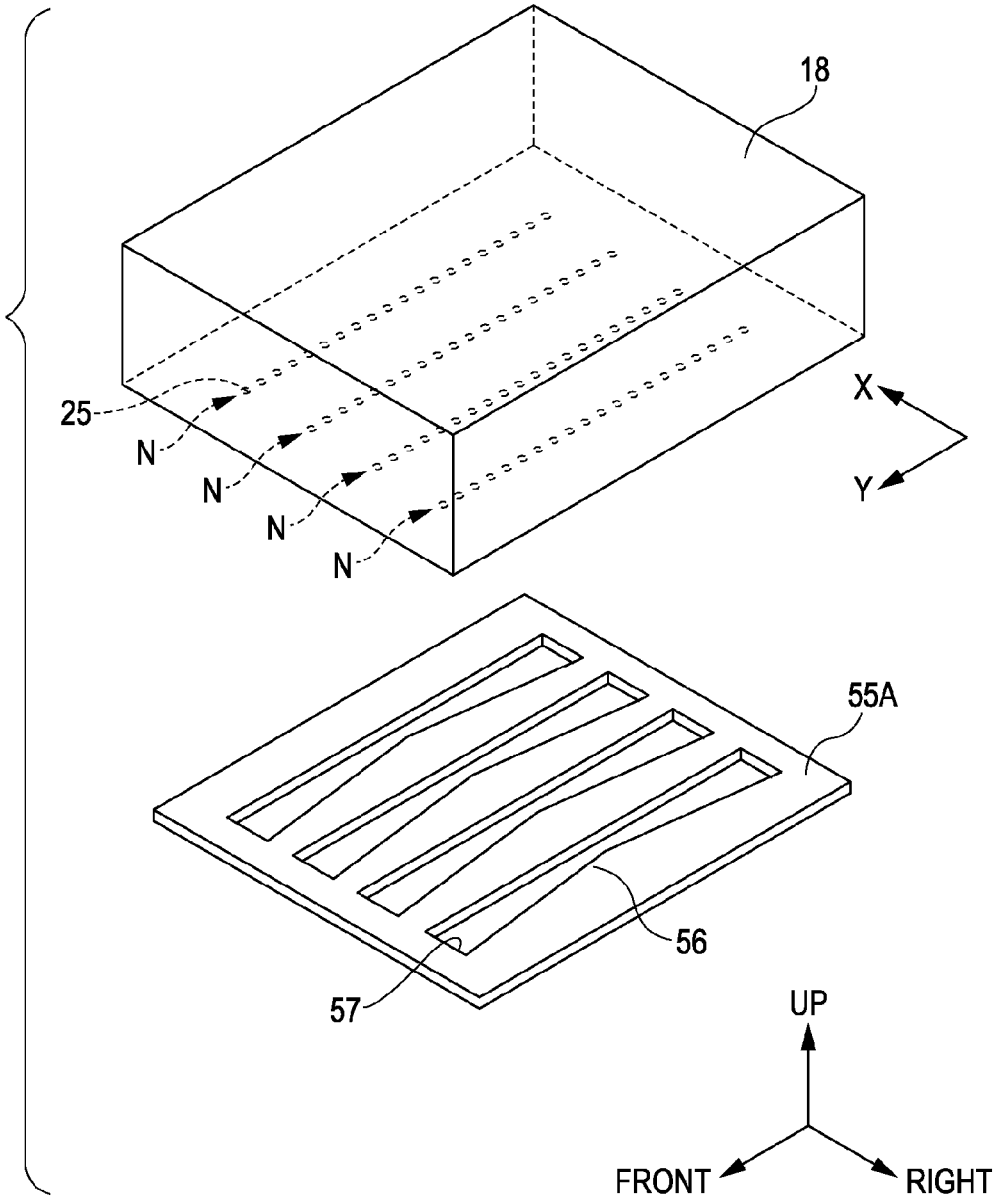
FIG. 8 is a perspective view showing a modification of the second embodiment.

In the second embodiment, for example, as shown in FIG. 8, a tight cap 55A having the abutting portions 56 and the openings 57 in the areas D1 in different shapes may be employed. In other words, in each of the areas D1, the abutting portion 56 the abutting portions 56 is partitioned from the opening 57 by a boundary line inclined from both ends in the direction of nozzle row Y toward the center so as to project toward the left. In this configuration, by moving the tight cap 55 continuously leftward at a constant speed, the nozzle openings 25 can be closed in sequence from the center side toward the both end sides without the need of complex control.

In the second embodiment, the carriage 17 may be moved in the lateral direction with respect to the tight cap 55. In this case, it is not necessary to provide a moving mechanism for moving the tight cap 55 in the lateral direction. In other words, what is essential is that the tight cap 55 and the fluid ejecting head 18 are configured to be capable of moving with respect to each other.

In the second embodiment, the area D1 to D3 may be positioned apart from each other, or may be changed in alignment sequence.

The pressure losses in the flow channels may be determined for the entire ink supply channels 20 irrespective of the shapes of the reservoirs 44. For example, when the ink supply channel 20 is branched into two branched flow channels having different lengths on the downstream side of the pressure regulating mechanism 28, and the respective branched flow channels are connected to the different reservoirs 44, the nozzle openings 25 of the nozzles 23 which receive the supply of ink through the shorter branched flow channels are closed in the first closing step. Also, the nozzle openings 25 of the nozzles 23 which receive the supply of ink through the longer branched flow channels may be closed in the second closing step.

It is also possible to provide a plurality of abutting members for one nozzle row N, so that the abutting members close the respective nozzle openings 25 of the nozzles 23 which constitute the nozzle row N at different timings.

The nozzles 23 are not limited to those formed through the nozzle plate 43, but may be formed of cylindrical thin tubes projecting from the fluid ejecting head 18.

The back pressures of the nozzles 23 may be adjusted by the pressure regulating mechanism 28. In this case, the differential pressure regulating valve 26 may not be provided. Also, the pressure regulating mechanism 28 may not be a component of the maintenance device 14.

The opening-and-closing valve 27 may not be provided.

The numbers of the fluid ejecting head 18 and the nozzles 23, and the number of rows of the nozzle rows N may be set arbitrarily. When a plurality of the nozzle rows N corresponding to the ink of the same color (the fluid of the same type) are provided so as to be adjacent to each other, the openings may be provided corresponding to the plurality of the nozzle rows.

Ink tanks which are not demountable can be employed as the ink cartridges 19.

The printer may be realized as a full-line type line head printer or a lateral type printer having an elongated fluid ejecting head.

In the embodiments described above, the fluid ejecting apparatus is embodied in the ink jet printer 11. However, a fluid ejecting apparatus which ejects or discharges fluid other than ink may also be employed, and may be used also in various types of liquid ejecting apparatuses having a liquid ejecting head configured to discharge a minute amount of liquid drops or the like. The term "liquid drop" indicates the state of liquid discharged from the liquid ejecting apparatus, and includes particle state, tear drop state, and thready state. The term "liquid" here may be any material as long as the liquid ejecting apparatus is able to eject. For example, it may be a substance in the state of liquid phase, and includes not only liquid state substance having a high or low viscosity, fluid state substance such as inorganic solvent such as sol and gel water, organic solvent, solution, liquid state resin, liquid state metal (melted metal), or liquid as a state of the substance, but also those obtained by dissolving, dispersing, or mixing particles of functional material formed of solid state substance such as pigment or metal particles in a solvent. Representative examples of the liquid include ink as described in the embodiment and liquid crystal. The term "ink" here includes various liquid compositions such as general water-based ink, oil-based ink, gel ink, hot-melt ink. Detailed examples of the liquid ejecting apparatus may include liquid ejecting apparatuses which ejects liquid containing materials such as electrode material or colorant in the form of dispersion or dissolution used for manufacturing, for example, liquid crystal displays, EL (electroluminescence) displays, surface emission-type displays, or color filters, liquid ejecting apparatuses which eject biological organic substance used for manufacturing biochips, liquid ejecting apparatuses which are used as accurate pipettes and eject liquid as a sample, text printing apparatuses, or microdispensers. Furthermore, liquid ejecting apparatuses for ejecting lubricant for pinpoint lubrication for precise machines such as watches or cameras, liquid ejecting apparatuses for ejecting transparent resin liquid such as UV-cured resin on a substrate for forming micro-semispherical lens (optical lens) used for optical communication elements or the like, and liquid ejecting apparatuses for ejecting etching liquid such as acid or alkali for etching the substrate or the like may be employed. The invention may be applied to any one of the liquid ejecting apparatuses.

What is claimed is:

1. A maintenance device for a fluid ejecting apparatus including a fluid ejecting head provided with a plurality of nozzles configured to eject fluid and fluid supply flow channels configured to supply the fluid toward a downstream side, which corresponds to the side of the fluid ejecting head, comprising:

a pressure regulating mechanism configured to reduce pressures in the fluid supply flow channels at a position of pressure reduction on an upstream side of the fluid ejecting head; and an abutting member configured to contact nozzle openings of the fluid ejecting head after the pressure reduction by the pressure regulating mechanism has started, so that the nozzle openings of the nozzles which receive a supply of the fluid through the flow channels which are subject to relatively small pressure losses are closed by priority according to the magnitudes of the pressure losses in the respective flow channels extending from the position of pressure reduction to the respective nozzles.

2. The maintenance device according to claim 1, wherein the abutting member closes the nozzle openings of the nozzle which receive the supply of the fluid though relatively short flow channels first by priority according to the lengths of the respective flow channels from the position of pressure reduction to the respective nozzles.

3. The maintenance apparatus according to claim 1, wherein the fluid supply flow channels each includes a storage portion extending along one direction for storing the fluid temporarily on the downstream side of the position of pressure reduction, an inflow hole configured to allow the fluid to flow into the storage portion, and a plurality of outflow holes arranged so as to be aligned along the one direction for supplying the fluid in the storage portion toward the respective nozzles, and the abutting member closes the nozzle openings of the nozzles which receive the supply of the fluid through the outflow holes located at shorter distances from the inflow hole first, and then closes the nozzle openings of the nozzles which receive the supply of the fluid through the outflow holes located at longer distances from the inflow hole.

4. The maintenance device according to claim 1, wherein the fluid supply flow channels further include an opening-and-closing valve which are capable of opening and closing the fluid supply flow channels at an opening and closing position on the upstream side of the position of pressure reduction.

5. The maintenance device according to claim 1, wherein the nozzle openings of the plurality of nozzles are arranged so as to be aligned on one plane, the abutting member is movable along the direction intersecting the one plane and, includes an abutting surface which assumes, when part of the nozzle openings of the plurality of nozzles are closed, a position apart from the nozzles other than the part of nozzles which are closed.

6. The maintenance device according to claim 1, wherein the fluid ejecting head is provided with a nozzle row including a plurality of the nozzles, and the nozzle openings of the plurality of nozzles are arranged so as to be aligned on one plane, the abutting member is slidable with respect to the one plane along a direction of movement intersecting a direction of the nozzle row, and including an abutting portion for closing the nozzle opening and an opening provided at a position adjacent to the abutting portion, and the abutting member includes a first area having the abutting portion and the opening arranged so as to be aligned in the direction of the nozzle row, a second area having the opening arranged at a position adjacent to the first area in the direction of movement, and a third area having the abutting portion arranged at a position adjacent to the first area or the second area in the direction of movement.

7. A fluid ejecting apparatus comprising:

a fluid ejecting head provided with a plurality of nozzles for ejecting fluid;

a fluid supply flow channel configured to supply the fluid toward the downstream side, which corresponds to the side of the fluid ejecting head; and the maintenance apparatus according to claim 1.

8. The fluid ejecting apparatus comprising:

a fluid ejecting head provided with a plurality of nozzles for ejecting fluid;

a fluid supply flow channel configured to supply the fluid toward the downstream side, which corresponds to the side of the fluid ejecting head; and the maintenance apparatus according to claim 2.

9. The fluid ejecting apparatus comprising:

a fluid ejecting head provided with a plurality of nozzles for ejecting fluid;

a fluid supply flow channel configured to supply the fluid toward the downstream side, which corresponds to the side of the fluid ejecting head; and the maintenance apparatus according to claim 3.

10. The fluid ejecting apparatus comprising:

a fluid ejecting head provided with a plurality of nozzles for ejecting fluid;

a fluid supply flow channel configured to supply the fluid toward the downstream side, which corresponds to the side of the fluid ejecting head; and the maintenance apparatus according to claim 4.

11. The fluid ejecting apparatus comprising:

a fluid ejecting head provided with a plurality of nozzles for ejecting fluid;

a fluid supply flow channel configured to supply the fluid toward the downstream side, which corresponds to the side of the fluid ejecting head; and the maintenance apparatus according to claim 5.

12. The fluid ejecting apparatus comprising:

a fluid ejecting head provided with a plurality of nozzles for ejecting fluid;

a fluid supply flow channel configured to supply the fluid toward the downstream side, which corresponds to the side of the fluid ejecting head; and the maintenance apparatus according to claim 6.

13. A maintenance method comprising:

starting a pressure reduction in an interior of a fluid supply flow channel configured to supply fluid toward a downstream side, which corresponds to a side of a fluid ejecting head having a plurality of nozzles for ejecting the fluid at a position of pressure reduction on the upstream side of the fluid ejecting head;

after having started the pressure reduction, contacting nozzle openings of part of nozzles which receive a supply of the fluid through flow channels which are subject to relatively small pressure losses according to the magnitudes of the pressure losses in the respective flow channels from the position of pressure reduction to the respective nozzles to close the nozzle openings of part of the nozzles; and contacting the nozzle openings of all the nozzles after the closing of the nozzle openings of part of the nozzles to close the nozzle openings of all the nozzles.

14. A maintenance device for a fluid ejecting apparatus including;

a fluid ejecting head having:

an inflow hole into which the fluid is supplied;

a first nozzle that ejects the fluid; and a second nozzle that ejects the fluid, the second nozzle arranged away from the inflow hole rather than the first nozzle; and a fluid supply flow channel supplying the fluid from an upstream side of the fluid ejecting head toward the first nozzle and the second nozzle through the inflow hole, the fluid supply flow channel comprising:

a pressure regulating mechanism configured to reduce a pressure in the fluid supply flow channel at a position of pressure on the upstream side of the fluid ejecting head; and an abutting member configured to contact a first nozzle opening of the first nozzle of the fluid ejecting head and a second nozzle opening of the second nozzle of the fluid ejecting head, in that order, when the pressure regulating mechanism is configured to reduce the pressure in the fluid supply flow channel.

* * * * *